US007093475B2

(12) United States Patent
Cappello et al.

(10) Patent No.: US 7,093,475 B2
(45) Date of Patent: Aug. 22, 2006

(54) ORBITAL MACHINE FOR BENDING TUBES

(75) Inventors: Serge Cappello, Taluyers (FR); Jean-Paul Chastan, Ecully (FR); Jean-Paul Bruyas, Charly (FR)

(73) Assignee: SILFAX, Vourles (FR)

( * ) Notice: Subject to any disclaimer, the term of this patent is extended or adjusted under 35 U.S.C. 154(b) by 71 days.

(21) Appl. No.: 10/928,199

(22) Filed: Aug. 30, 2004

(65) Prior Publication Data

US 2005/0056071 A1 Mar. 17, 2005

(30) Foreign Application Priority Data

Sep. 12, 2003 (FR) ..... 03 10754

(51) Int. Cl.
*B21D 7/02* (2006.01)

(52) U.S. Cl. ..... 72/307

(58) Field of Classification Search ..... 72/307, 72/306, 149, 159, 388
See application file for complete search history.

(56) References Cited

U.S. PATENT DOCUMENTS 4,604,885 A * 8/1986 Lang ..... 72/306
4,655,069 A * 4/1987 Remy et al. ..... 72/306
4,735,075 A 4/1988 Saegusa
5,193,378 A * 3/1993 Ritter et al. ..... 72/294
5,765,426 A 6/1998 Saegusa
5,901,596 A 5/1999 Tetzloff et al.
6,237,380 B1 5/2001 Kanamori
6,434,995 B1 8/2002 Kataoka et al.
6,857,303 B1 * 2/2005 Latour ..... 72/307

FOREIGN PATENT DOCUMENTS

EP 1291094 3/2003
WO WO 01/74512 A1 * 10/2001

* cited by examiner

*Primary Examiner*—Daniel C. Crane
(74) *Attorney, Agent, or Firm*—Young & Thompson

(57) ABSTRACT

An orbital machine for bending tubes includes a fixed base frame on which is displaced in translation a guiding support cooperating with a feed-off arm driven in rotation around a horizontal axis and that forms an integral unit with a bending head having two tightening semi-rollers that are driven first according to a direction opposite in direction from the axis of the tube in a plane perpendicular to that of the bending plane XX' of the tube, and secondly in rotation to achieve at least one bending on the tube, the base frame including a loading device allowing the tube to be bent to be held first in a horizontal position oriented in the direction of the bending head and secondly in a position that is fixed in rotation and in translation while the different bendings are achieved.

12 Claims, 6 Drawing Sheets

ORBITAL MACHINE FOR BENDING TUBES

The present invention is related to a machine for bending tubes and more particularly to an orbital machine for bending small-diameter tubes.

The object of the orbital machine according to the present invention is to achieve bendings on small-diameter tubes by maintaining the latter in a horizontal position that is fixed in rotation and in translation while different bendings are performed.

The orbital machine for bending tubes according to the present invention comprises a fixed base frame on which is displaced in translation a guiding support cooperating with a feed-off arm driven in rotation around a horizontal axis and which forms an integral unit with a bending head comprising two tightening semi-rollers that are driven first according to a direction opposite in orientation from the axis of the tube in a plane perpendicular to that of the bending plane XX' of the tube, and secondly in rotation to achieve at least one bending on the tube, said base frame comprising a loading device allowing the tube to be bent to be maintained first in a horizontal position oriented in the direction of the bending head and secondly in a position that is fixed in rotation and in translation while different bendings are performed.

The orbital machine according to the present invention comprises a guiding support that is comprised of a vertical column comprising first at its base a horizontal plate equipped with guiding means cooperating with the rails that form an integral part with the fixed base frame and secondly, opposite from its plate, a turret driven in rotation and forming an integral part with the U-shaped feed-off arm.

The orbital machine according to the present invention comprises a feed-off arm comprising a first part that is fixed on the turret, a second part parallel to the first and forming an integral part with the bending head, and a third part interconnecting the first two parts.

The orbital machine according to the present invention comprises a bending head that is comprised of a tightening support equipped with two tightening semi-rollers and a guide strip support that forms an integral unit with a fixed or sliding gripping jaw.

The orbital machine according to the present invention comprises a bending head wherein each tightening semi-roller of the tightening support presents an indentation for receiving the tube to be bent.

The orbital machine according to the present invention comprises a groove support wherein the tightening semi-rollers are guided respectively in translation in the slide bars provided in the tightening support in order to be able to either shorten or extend the longitudinal axis of the tube.

The orbital machine according to the present invention comprises a groove support that is axially guided in a plate that forms an integral unit with a second part of the arm to be able to drive the mobile bending grooves in rotation.

The orbital machine according to the present invention comprises a guide strip support comprising a dovetail-shaped plate that forms an integral unit with a driving and guiding device allowing displacement in translation of the gripping jaw in the direction of the tube to be ensured.

The orbital machine according to the present invention comprises a loading device comprising first a storage channel that is fixed on a vertical extension arm that forms an integral unit with the base frame so as to present the tubes to be bent in a vertical position and secondly above the channel a gripping device that allows the tubes to be held in a channel in order to present the tubes in a horizontal position oriented in the direction of the bending head.

The orbital machine according to the present invention comprises a loading device comprising a gripping device that is comprised of a driving device allowing an arm to be pivoted, displacing the arm from a vertical position to a horizontal position.

The description to follow with regard to the attached drawings, given by way of a non-limiting example, will allow the invention, the characteristics that the invention presents, and the advantages that the invention is likely to bring about to be better understood:

Figure 1:
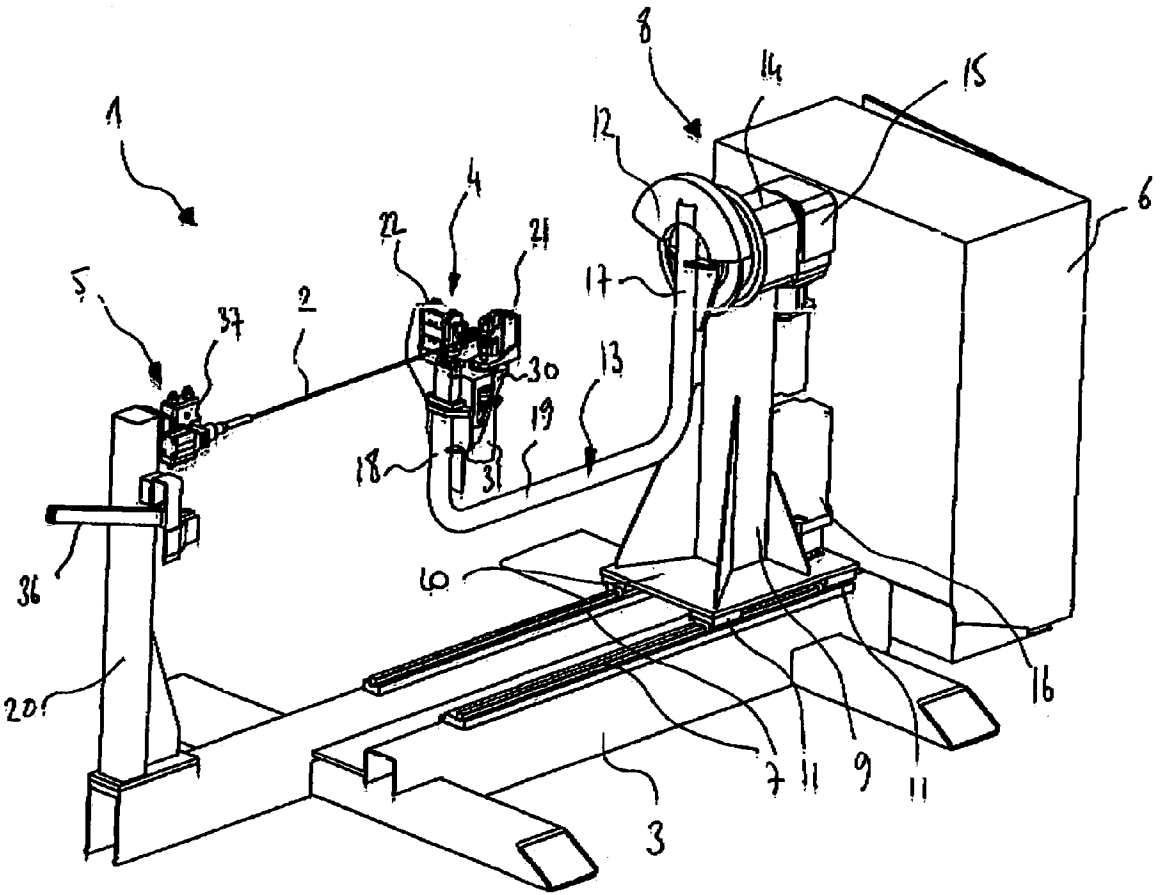
FIG. 1 is a perspective view illustrating the bending machine according to the present invention.
Figure 2:
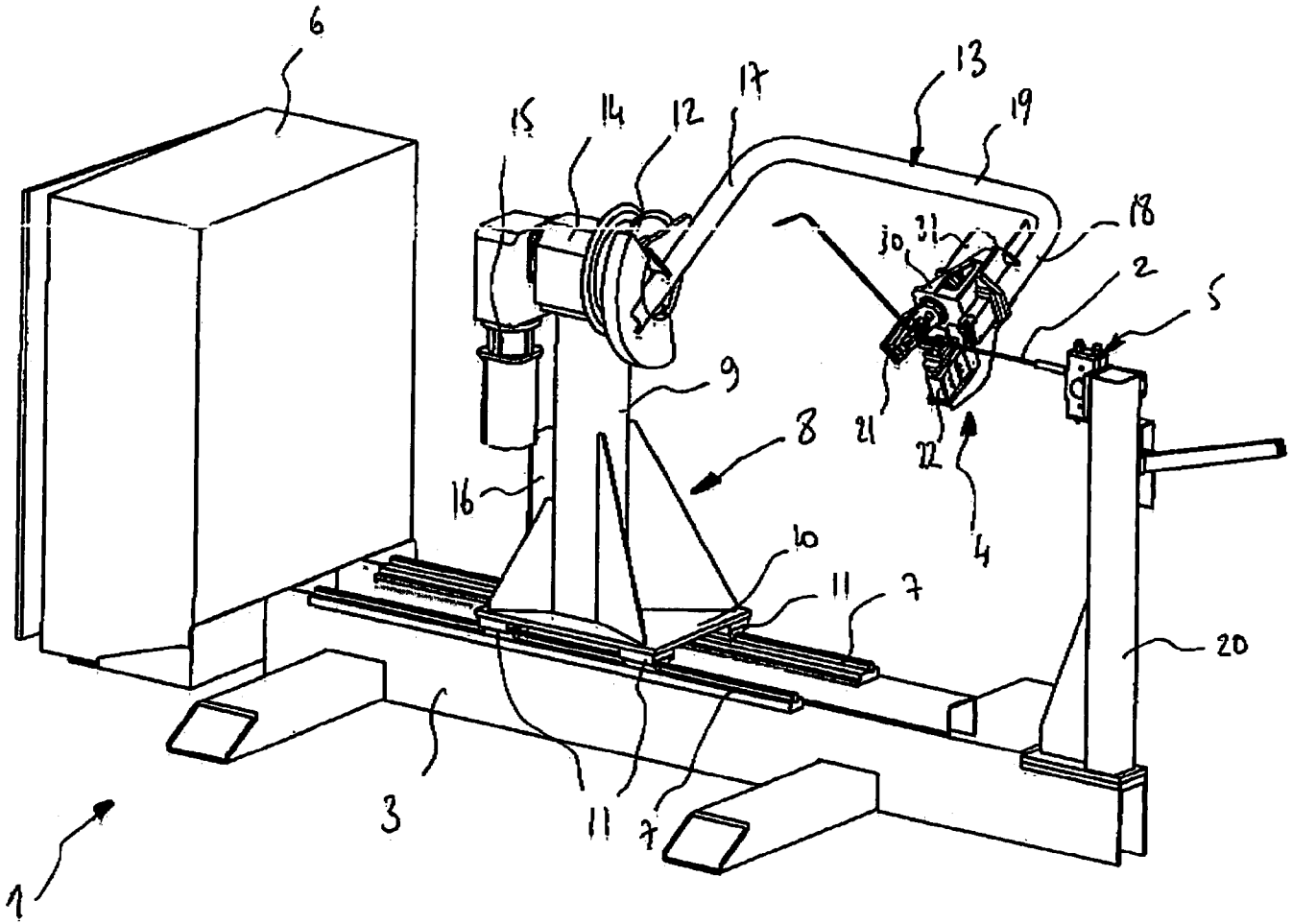
FIG. 2 is a perspective view representing the bending machine according to the present invention in a bending position by displacement in rotation of its bending head.

FIGS. 1 and 2 show an orbital machine 1 for bending small-diameter tube 2 comprising a fixed base frame 3, a bending head 4, a loading device 5 and an electrical control enclosure 6.

The fixed base frame comprises two parallel guiding rails 7 on which a guiding support 8 slides bearing the bending head 4 at its free extremity.

The guiding support 8 is comprised of a vertical column 9 comprising at its base a horizontal plate 10 equipped with guiding means 11 cooperating with the rails 7 of the fixed base frame 3.

The vertical column 9 comprises, opposite from the plate 10, a turret 12 guided in rotation and forming an integral unit with a U-shaped feed-off arm 13.

The turret 12 is driven in rotation around a horizontal axis through a guide bearing 14 forming an integral unit with the vertical column 9 and a geared motor 15.

The guiding support 8 is displaced in translation on the rail 7 of the fixed base frame 3 through another geared motor 16 disposed at the plate 10.

The U-shaped feed-off arm 13 comprises a first part 17 that is fixed on the turret 12, a second part 18 parallel to the first forming an integral unit with the bending head 4, and a third part 19 interconnecting the first two parts 17, 18.

The fixed base frame 3 comprises at one of its extremities and opposite from the electrical control enclosure 6, a vertical extension arm 20 that forms an integral unit with the loading device 5 allowing the tubes 2 to be positioned with relation to the bending head 4.

Figure 3:
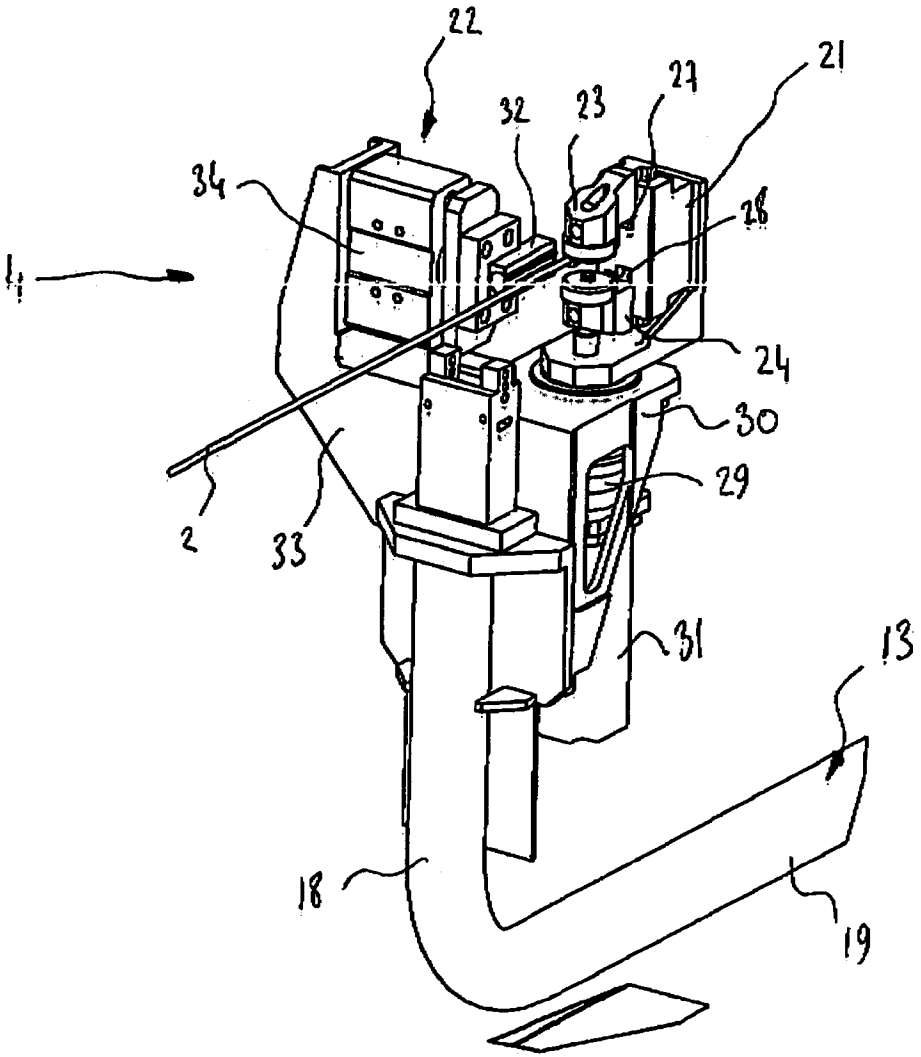
FIG. 3 is a detailed view showing the bending head of the bending machine according to the present invention.
Figure 4:
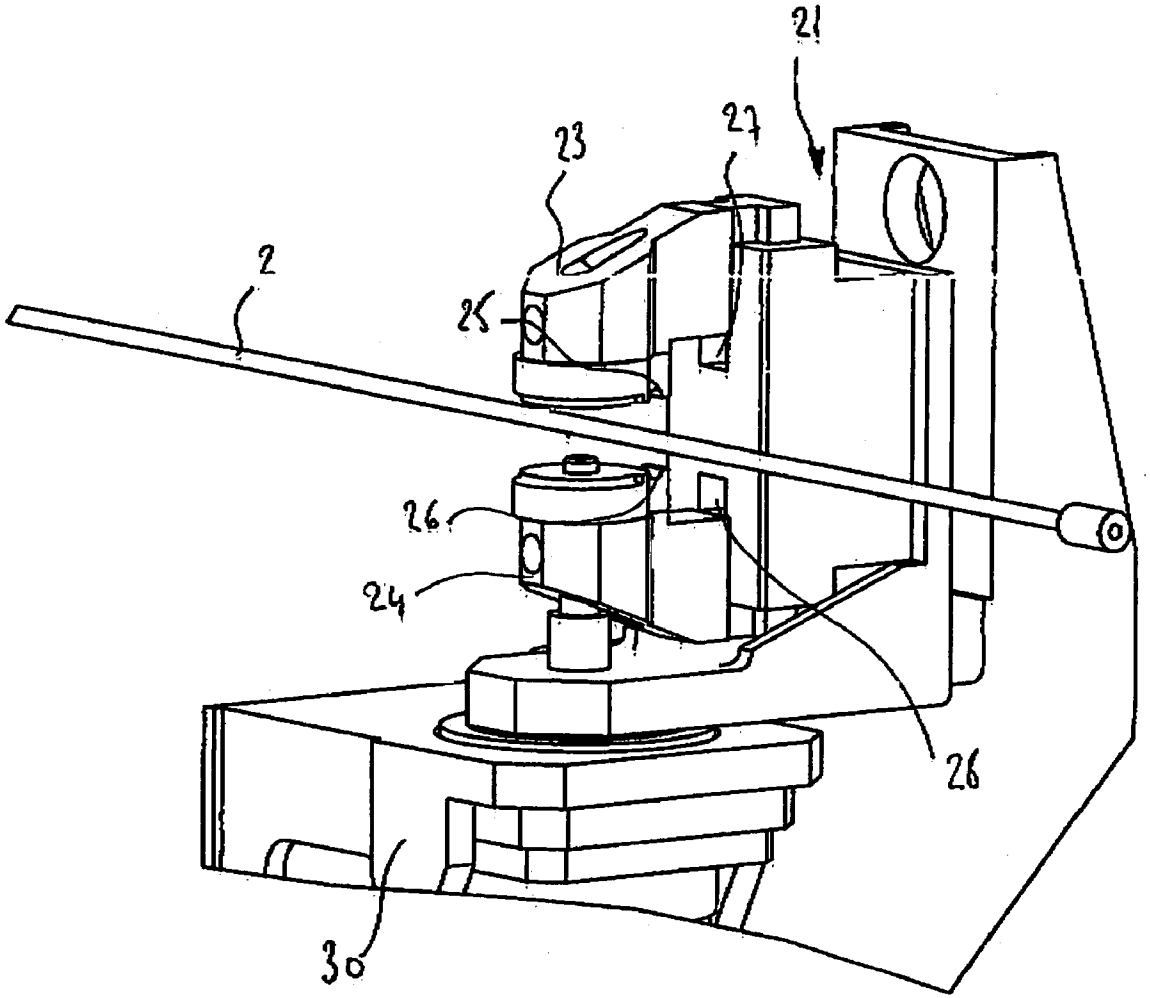
FIGS. 4 and 5 are views illustrating the different positions of the mobile bending grooves of the bending head of the bending machine according to the present invention.
Figure 5:
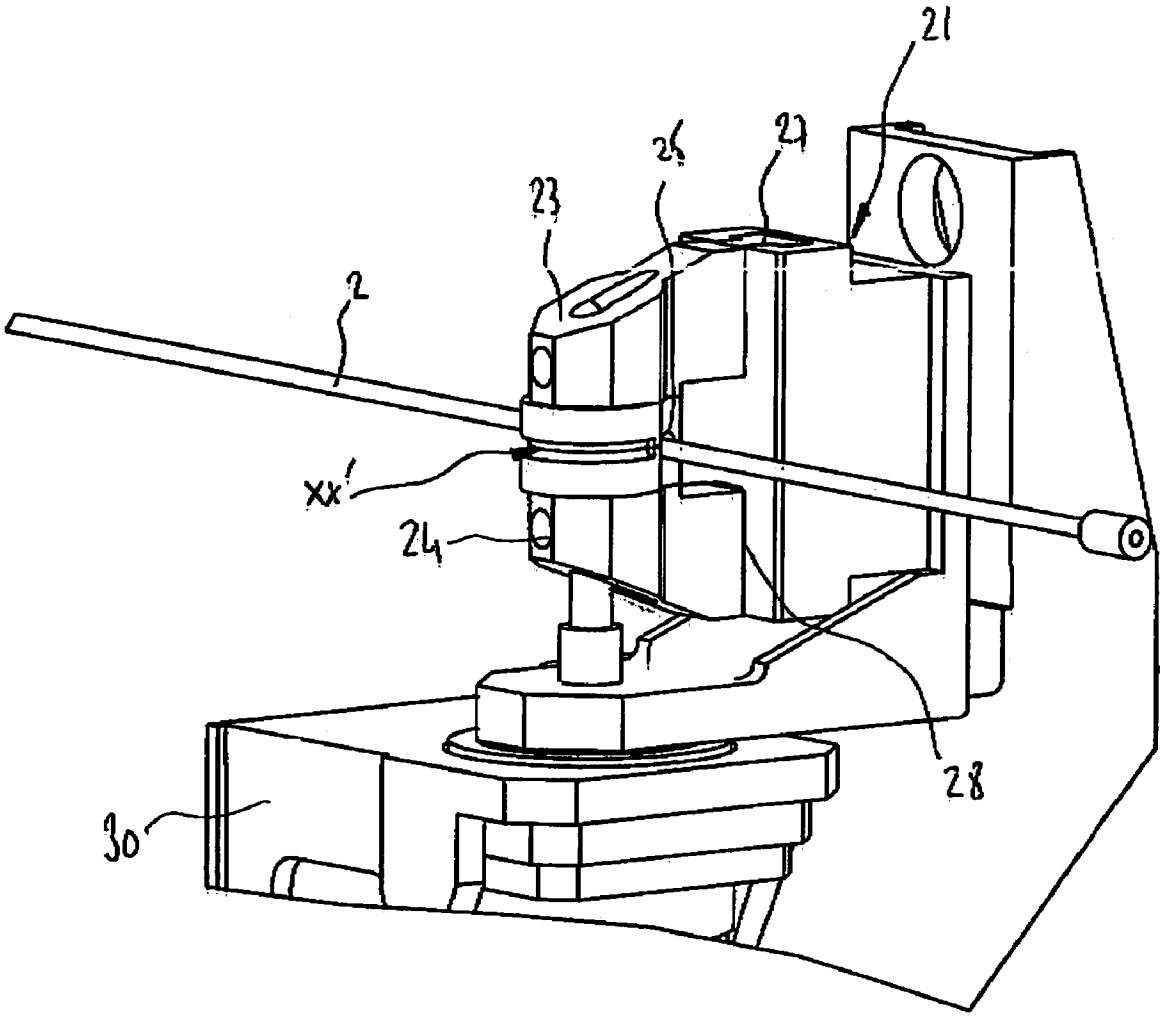

FIGS. 3 to 5 show the U-shaped feed-off arm 13 that forms an integral unit at one of its extremities with the bending head 4 allowing the tube 2 to be bent.

The bending head 4 is comprised of a tightening support 21 and a guide strip support 22 displaced independently and according to different directions.

The tightening support 21 comprises two tightening semi-rollers 23, 24 each presenting an indentation 25, 26 for receiving the tube to be bent 2.

Each tightening semi-roller 23, 24 is displaced according to a direction opposite from the direction of the axis of the tube 2 in order to achieve a vertical tightening around said tube that is comprised in a plane perpendicular to that of the bending plane XX', as shown in FIG. 5.

In our embodiment example, it is noted that each tightening semi-roller 23, 24 is displaced according to a direction opposite from the direction of the axis of tube 2 that is contained in a plane parallel to that bearing the second part 18 of the U-shaped feed-off arm 13.

Thus, the tightening semi-rollers 23, 24 are guided respectively in translation in the slide bars 27, 28 provided in the tightening support 21 in order to be able to be shortened for tightening the tube 2, or to be extended in the longitudinal axis of the tube 2 according to the different bending steps of the latter.

The displacement in translation of the tightening semi-rollers 23, 24 is ensured by the tightening support 21 that is comprised of a parallel tightening hydraulic or pneumatic or electric device.

The tightening support 21 is guided axially and, more particularly, in rotation in a plate 30 that forms an integral unit with the second part 18 of the arm 13 allowing the tightening semi-rollers 23, 24 to be displaced in rotation and, more particularly, in rotation around their displacement in translation axes.

The displacement in rotation of a tightening support 21 is ensured by an electric geared motor or hydraulic or pneumatic type driving device 31.

The guide strip support 22 forms an integral unit with a fixed or sliding gripping jaw 32 that is guided in translation in order that the tube that is to be bent 2 may be shortened or extended according to the different bending steps of the latter.

The guide strip support 22 comprises a dovetail shaped plate 33 that forms an integral unit with an electric actuator or hydraulic or pneumatic type driving and guiding device allowing the displacement in translation of the gripping jaw 32 in the direction of the tube 2 to be ensured.

Figure 6:
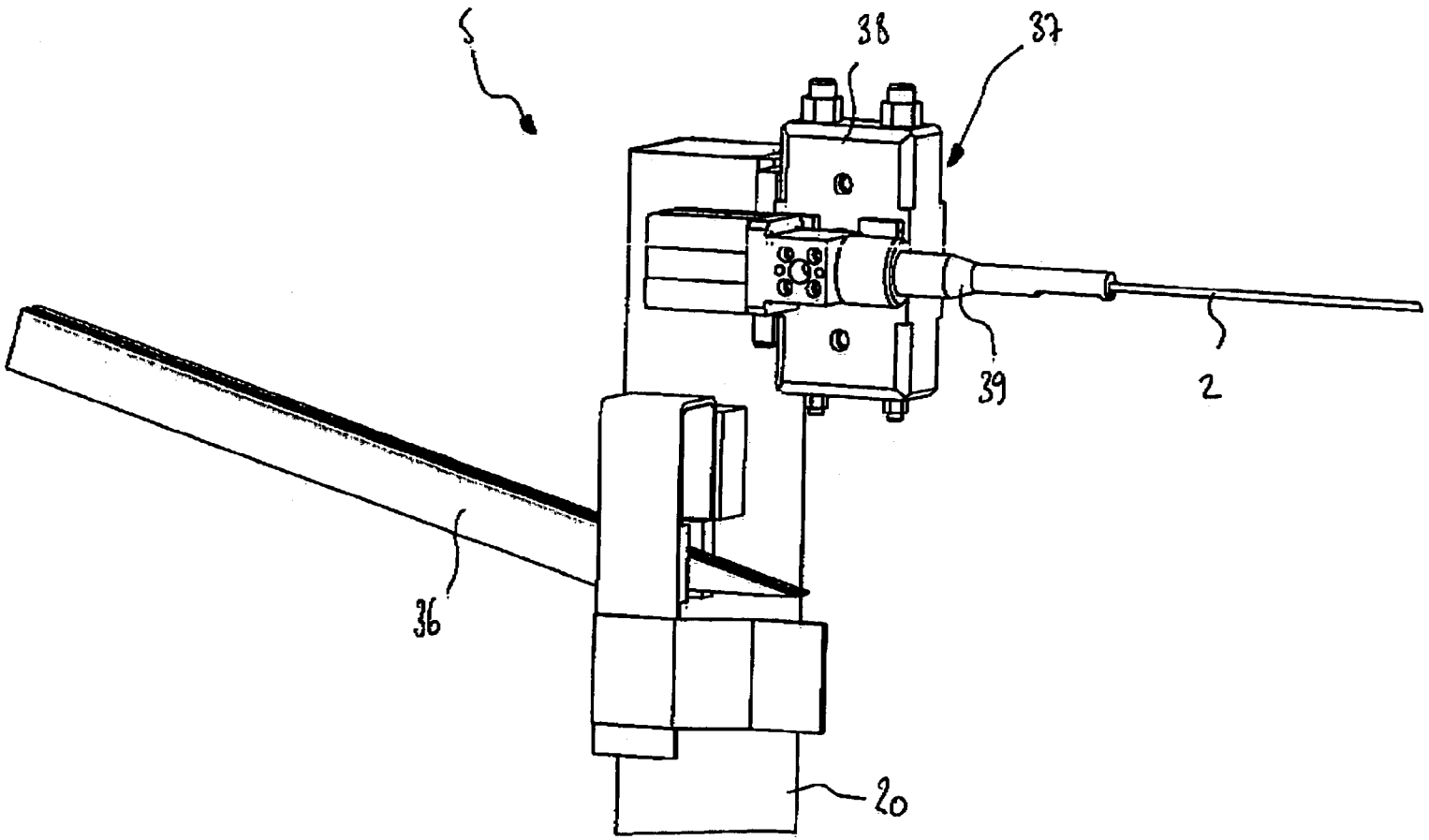
FIG. 6 is a perspective view showing the loading device for the tubes to be bent in the bending machine according to the present invention.

FIG. 6 represents the loading device 5 allowing the tube 2 to be held in a fixed and identical position while different bends are achieved by means of the bending head 4.

The loading device 5 is fixed and positioned on the vertical extension arm 20 forming an integral unit with the base frame 3 of the bending machine 1.

The loading device 5 comprises a storage channel 36 that is fixed on the vertical extension arm 20 so as to present tubes to be bent 2 in a vertical direction oriented in the direction of the base frame 3 of the bending machine 1.

The loading device 5 comprises a gripping device 37 above the channel 36 that forms an integral unit with the vertical extension arm 20 allowing the tubes 2 to be taken in the channel 36 so that the tubes are presented in a horizontal position oriented in the direction of the bending head 4.

The gripping device 37 is comprised of a driving device 38 allowing the arm 39 to be pivoted, displacing the arm from a vertical position to a horizontal position.

The arm 39 allows, in its vertical position that is roughly parallel to the extension arm 20, the tube 2 suspended in the channel 36 to be recovered and to be brought to a horizontal position near the bending head 4 through pivoting of said arm.

The arm 39 allows the tube to be bent 2 to be held in a fixed and given position in order that the latter may not be displaced in translation and in rotation while the different bendings by means of the bending head 4 are achieved.

It may be easily understood from the description above that the bendings of the tube 2 are obtained by different displacements either in translation or in rotation of the feed-off arm 13 and the bending head 4.

In fact, the arm 13 and the bending head 4 may either be shortened or extended from the vertical extension arm 20 by horizontal displacement in translation of the guiding support 8 on the rails 7 of the base frame 3.

Also, the arm 13 and the bending head 4 may be displaced in rotation around the longitudinal axis of the bending machine 1 that is represented by the horizontal position of the tube 2 before a bend is achieved. This rotation is obtained by the pivoting of the turret 12 around a horizontal axis through a geared motor 15.

Lastly, the tightening semi-rollers 23, 24 of the bending head 4 pivot in rotation around an axis contained in a plane parallel to that of the second part 18 of the feed-off arm 13 during bending of the tube 2.

Thus, the combination of different displacements of the bending head 4 allow at least one bend to be achieved on a tube 2 that remains fixed in rotation and in translation with relation to said bending head 4.

It may be noted that the loading device 5 or gripping device 37 may be of any type, for example the tube to tube transfer by pivoting in the horizontal plane type without changing the object of the present invention.

In addition, it must be understood that the previous description was given only by way of example and does not limit in any way the scope of the invention, wherein details of the executions described may be replaced by other equivalents without any departure from this scope.

The invention claimed is:

1. An orbital machine for bending tubes (2), characterized in that the machine comprises a fixed base frame (3) on which a guiding support (8) is displaced in translation, said guiding support is comprised of a vertical column (9) comprising first at its base a horizontal plate (10) equipped with guiding means (11) cooperating with rails (7) forming an integral unit with the fixed base frame (3) and secondly opposite from the plate (10) a turret (12) driven in rotation and forming an integral unit with a U-shaped feed-off arm (13), said feed-off arm (13) driven in rotation around a horizontal axis and which forms an integral unit with a bending head (4) comprising one of a tightening roller associated with a gripping jaw and two tightening semi-rollers (23, 24) that are driven first according to a direction opposite in direction from the axis of the tube (2) in a plane perpendicular to that of a bending plane XX' of the tube (2), secondly in rotation to achieve at least one bend on the tube (2), said base frame (3) comprising a loading device (5) allowing the tube to be bent (2) to be held first in a horizontal position oriented in the direction of the bending head (4) and secondly in a position that is fixed in rotation and in translation while the different bendings are achieved.

2. The orbital machine for bending tubes (2) according to claim 1, characterized in that the feed-off arm (13) comprises a first part (17) that is fixed on the turret (12), a second part (18) parallel to the first and forming an integral unit with the bending head (4), and a third part (19) interconnecting the first two parts (17, 18).

3. The orbital machine for bending tubes (2) according to claim 1, characterized in that the bending head (4) is comprised of a tightening support (21) equipped with two tightening semi-rollers (23, 24) and a guide strip support (22) forming an integral unit with a fixed or sliding gripping jaw (32).

4. The orbital machine for bending tubes (2) according to claim 1, characterized in that each tightening semi-roller (23, 24) of the tightening support (21) presents an indentation (25, 26) for receiving the tube to be bent (2).

5. The orbital machine for bending tubes (2) according to claim 4, characterized in that the tightening semi-rollers (23, 24) are guided respectively in translation in slide bars (27, 28) provided in the tightening support (21) in order to be able to either shorten or extend the longitudinal axis of the tube (2).

6. The orbital machine for bending tubes (2) according to claim 3, characterized in that the tightening support (21) is guided axially in rotation in a plate (30) allowing the tightening semi-rollers (23, 24) to be displaced in rotation.

7. The orbital machine for bending tubes (2) according to claim 3, characterized in that the guide strip support (22) comprises a dovetail shaped plate (33) that forms an integral unit with a driving and guiding device (34) allowing the displacements in translation of the gripping jaw (32) in the direction of the tube (2) to be ensured.

8. The orbital machine for bending tubes (2) according to claim 1, characterized in that the loading device (5) comprises first a storage channel (36) that is fixed on a vertical extension arm (20) forming an integral unit with the base frame (3) in such a way as to present the tubes (2) to be bent in a vertical position and secondly a gripping device (37) above the channel (36) that allows the tubes (2) in the channel (36) to be taken in order to present the tubes in a horizontal position oriented in the direction of the bending head (4).

9. The orbital machine for bending tubes (2) according to claim 8, characterized in that the gripping device (37) is comprised of a driving device (38) allowing an arm (39) to be pivoted, displacing the arm from a vertical position to a horizontal position.

10. An orbital machine for bending tubes (2), characterized in that the machine comprises a fixed base frame (3) on which a guiding support (8) is displaced in translation cooperating with a fee-doff arm (13) driven in rotation around the horizontal axis and which forms an integral unit with a bending head (4) comprising two tightening semi-rollers (23, 24) that are driven first according to a direction opposite in direction from the axis of the tube (2) in a plane perpendicular to that of the bending plane XX'of the tube (2), secondly in rotation to achieve at least one bend on the tube (2), said base frame (3) comprising a loading device (5) allowing the tube to be bent (2) to be held first in a horizontal position oriented in the direction of the bending head (4) and secondly in a position that is fixed in rotation and in translation while the different bendings are achieved, in that each tightening semi-roller (23, 24) of the tightening support (21) presents an indentation (25, 26) for receiving the tube to be bent (2), and that the tightening semi-rollers (23, 24) are guided respectively in translation in slide bars (27, 28) provided in the tightening support (21) in order to be able to either shorten or extend the longitudinal axis of the tube (2).

11. An orbital machine for bending tubes (2), characterized in that the machine comprises a fixed base frame (3) on which a guiding support (8) is displaced in translation cooperating with a feed-off arm (13) driven in rotation around the horizontal axis and which forms an integral unit with a bending head (4) comprising two tightening semi-rollers (23, 24) that are driven first according to a direction opposite in direction from the axis of the tube (2) in a plane perpendicular to that of the bending plane XX'of the tube (2), secondly in rotation to achieve at least one bend on the tube (2), said base frame (3) comprising a loading device (5) allowing the tube to be bent (2) to be held first in a horizontal position oriented in the direction of the bending head (4) and secondly in a position that is fixed in rotation and in translation while the different bendings are achieved, characterized in that the loading device (5) comprises first a storage channel (36) that is fixed on a vertical extension arm (20) forming an integral unit with the base frame (3) in such a way as to present the tubes (2) to be bent in a vertical position and secondly a gripping device (37) above the channel (36) that allows the tubes (2) in the channel (36) to be taken in order to present the tubes in a horizontal position oriented in the direction of the bending head (4).

12. The orbital machine for bending tubes (2) according to claim 11, characterized in that the gripping device (37) is comprised of a driving device (38) allowing an arm (39) to be pivoted, displacing the arm from a vertical position to a horizontal position.

* * * * *